US006543826B1

(12) United States Patent
Aston

(10) Patent No.: US 6,543,826 B1
(45) Date of Patent: Apr. 8, 2003

(54) LIFTING DEVICE

(76) Inventor: John Alexander Aston, 28 Manordougherty Road, Markethill, County Armagh, BT60 1TY, Northern Ireland (GB)

( * ) Notice: Subject to any disclaimer, the term of this patent is extended or adjusted under 35 U.S.C. 154(b) by 0 days.

(21) Appl. No.: 09/555,130

(22) PCT Filed: Nov. 25, 1998

(86) PCT No.: PCT/GB98/03518

§ 371 (c)(1),
(2), (4) Date: Jul. 25, 2000

(87) PCT Pub. No.: WO99/26874

PCT Pub. Date: Jun. 3, 1999

(30) Foreign Application Priority Data

Nov. 25, 1997 (GB) ..... 9725089

(51) Int. Cl.[7] ..... B66C 1/18
(52) U.S. Cl. ..... 294/74; 294/119.2
(58) Field of Search ..... 294/31.2, 67.1, 294/67.3, 67.4, 74, 77, 82.12, 149, 150, 119.2

(56) References Cited

U.S. PATENT DOCUMENTS

| | | | | | |
|---|---|---|---|---|---|
| 873,044 | A | * | 12/1907 | Hanson | 294/74 |
| 2,092,107 | A | * | 9/1937 | Coleman | 294/77 |
| 3,148,427 | A | * | 9/1964 | Hoffstrom | 294/74 X |
| 3,339,965 | A | * | 9/1967 | Berns | 294/74 |
| 3,527,493 | A | * | 9/1970 | Phares | 294/74 |
| 4,009,898 | A | * | 3/1977 | Hampton | 294/119.2 X |
| 4,101,109 | A | * | 7/1978 | Edwards | 294/74 X |
| 4,133,568 | A | * | 1/1979 | Williams | 294/74 |
| 4,826,228 | A | * | 5/1989 | Dinitz et al. | 294/74 X |
| 5,641,189 | A | * | 6/1997 | Landman | 294/74 X |

FOREIGN PATENT DOCUMENTS

| | | | | |
|---|---|---|---|---|
| FR | 2409933 | * | 6/1979 | 294/74 |

* cited by examiner

*Primary Examiner*—Johnny D. Cherry
(74) *Attorney, Agent, or Firm*—Ronald E. Greigg

(57) ABSTRACT

A lifting device which has a flexible belt adapted to circumvent and grip a load to be lifted. One or more elongate flexible lifting straps is in spaced relationship around the belt. One end of the or each strap is securable on the belt anywhere along the belt's length. The other end of the or each strap has a lift attachment.

14 Claims, 4 Drawing Sheets

LIFTING DEVICE

BACKGROUND OF THE INVENTION

1. Field of the Invention

The present invention relates to a lifting device.

The lifting for relocation of certain loads by suspended slings, straps, nets, etc. can be difficult for several reasons. If heavy, it is difficult to lift initially the load to locate a sling thereunder. Moreover, it may not be wanted to lift the load from underneath if the load is being stacked or stored on top of something. If the load is an awkward shape, other conventional lifting apparatus may not be appropriate. It is also desired to have a lifting device which is quick and simple to locate and secure around the load, and quick and simple to detach after use.

2. Description of the Prior Art

Heretofore, FR-A-2 409 933 has disclosed a lifting device which comprises a flexible belt adapted to circumvent and grip a load to be lifted, and one or more elongate flexible straps in spaced relationship around the belt, one end of the or each strap being securable on the belt anywhere along the belt's length, and the other end of the or each strap having lift attachment means, the straps being positionable anywhere around the belt to give the lifting device the facility of being able to accommodate loads of shapes and or sizes and of differing centres of gravity; U.S. Pat. No. 3,120,403 disclosed a sling having two or more elongate flexible straps for spaced relationship around a load to be lifted, the upper end of the straps being brought together and secured on a lift attachment ring, the straps being length-adjustable; and DE-93 17 824U disclosed lifting means including a hook adapted to allow rotation of the hook and thus a load, in use.

SUMMARY OF THE INVENTION

According to one aspect of the present invention, there is provided a lifting device comprising a flexible belt adapted to circumvent and grip a load to be lifted, and two or more elongate flexible lifting straps in spaced relationship around the belt, one end of each strap being securable on the belt anywhere along the belt's length, the other end of each strap having lift attachment means formed by a common attachment head to which the other or upper ends of the straps are brought together and secured, wherein the common attachment head is a multi-sided load plate having inward of each side an elongate slot.

Preferably, the load plate is of substantial triangular shape. Three straps are desirably used and the upper end of each strap is provided with a loop. The straps may be secured to the load plate by the looped upper end of each strap being passed through a respective slot, and therethrough is opened and a dumbell pin is threaded through for the webbing of the corresponding strap to seat between the enlarged ends of the pin. The pin is beneficially of greater diametrical width than the width of a respective slot with the enlarged ends seating on the load plate. The common attachment head is preferably adapted to allow rotation of the device, and thus also the load, in use.

The belt of the present invention can be located and arranged to circumvent the load howsoever. Either prior to or after fully gripping the load, the straps are positioned and spaced so as to extend from the most suitable and stable positions from the belt. By being able to position the straps anywhere around the belt, the lifting device can accommodate loads of differing, especially unusual or irregular, shapes, sizes etc., and of differing centres of gravity.

Where the belt is elongate (as opposed to continuous), it may include a belt fastening means, which means may be any suitable means such as a buckle, a catch and hook or other two part fastener. Preferably the fastening means allows quick attachment and detachment of the ends of the belt.

In some instances, fastening the belt ends together may be sufficient for the belt to grip the load (upon lifting). Alternatively, the belt includes a belt tightening means to help the belt grip the load, e.g. buckle, ratchet and pawl, etc. Preferably, the lifting device includes both belt fastening and belt tightening means to provide maximum flexibility of use.

Preferably, the lifting straps are detachable from the belt either directly or slidingly, such that they can be readily added or removed as desired or necessary. Three or four straps will usually be sufficient for most loads. The straps may be length-adjustable.

The lifting device of the present invention occupies little room in storage, and is easily and quickly locatable and securable around loads of different shapes, diameters and weights. Such loads include agricultural bales, e.g. straw, hay and silage bales, barrels, vessels, vats etc. of liquid, bags, tires, boats, engines, rubble, pipes, etc.

Upon lifting of the straps, the circumferential belt is pulled into the load which assists the grip therebetween. The belt provides non-abrasive gripping of the load. The ability to position the lifting straps anywhere around the belt ensures that the load can be correctly and securely lifted, and helps to ensure that there is central weight load transfer from the load to the lifting means.

A second (or more) set of lifting straps and belt may be added below the first belt and dependent therefrom. This can create a series of belts for gripping elongate and/or more awkward loads. In use, the belts need not be of the same circumferential length, i.e. they could fit loads of varying circumference or width, e.g. large bottles.

The lift attachment means may be attached to any suitable lifting means capable of carrying the proposed load. For agricultural uses, the lifting means can be a hook on the linkage mechanism of a tractor.

The belt and straps may be made of any suitable material, preferably a material which is lightweight yet still strong, and non-abrasive. One such material is reinforced fibre webbing, similar to that used for vehicle seat belts, vehicle towing belts or load restraining on commercial vehicles. Preferably, the material is also vermin, water and chemical resistant. The belt may be of any design e.g. flat, ribbed, solid, chain, round, etc.

BRIEF DESCRIPTION OF THE DRAWINGS

Embodiments of the present invention will now be described, by way of example, with reference to the accompanying drawings, in which.

DESCRIPTION OF THE PREFERRED EMBODIMENTS

Figure 1:
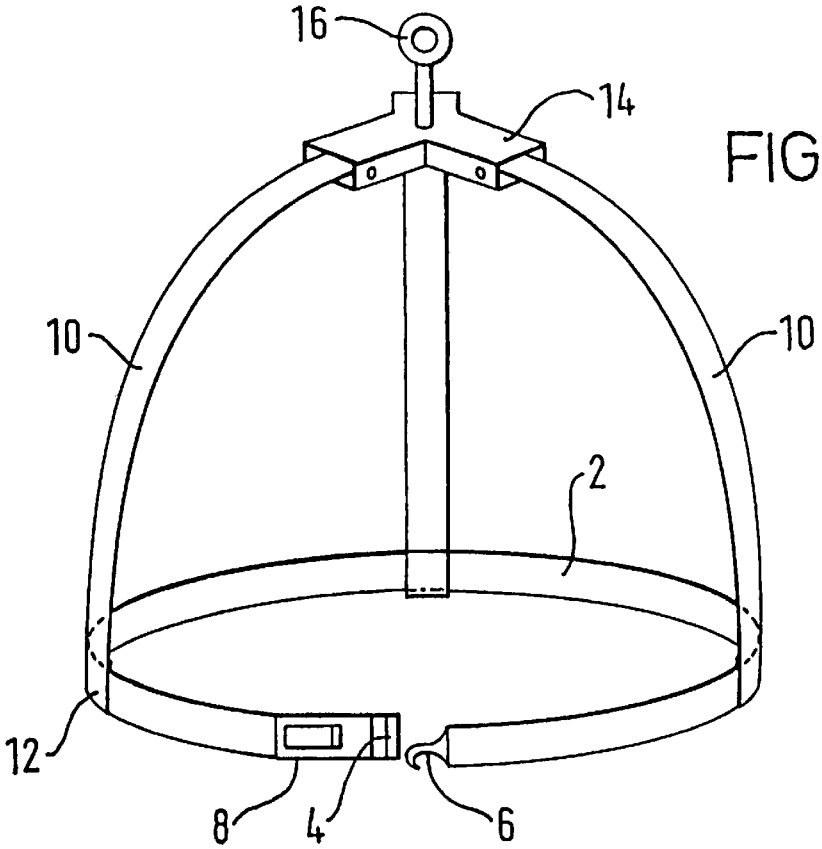
FIG. 1 is a perspective view of a lifting device according to one embodiment of the present invention.

Referring to FIG. 1 of the drawings, a lifting device according to a first embodiment comprises an elongate flexible belt 2. The ends of the belt 2 have a two-part belt fastening means comprising a fastening rod 4 and connecting claw 6. The claw 6 fits around the rod 4 to fasten the belt 2. Next to the rod 4 is a ratchet tensioner 8 as a belt tightening means.

Extending upwardly from the belt 2 are three lifting straps 10 which have lift attachment means at their upper ends. A loop 12 is created at the lower end of each strap 10 by securing the end of the strap 10 to itself. The belt 2 fits through the loops 12, securing the straps 10 on the belt 2 in use. When not in use, or prior to full lifting, the loops 12 allow the straps 10 to be positioned anywhere along the length of the belt 2.

The upper ends of the straps 10 are brought together and secured to a common attachment head 14 having a rotatable lifting ring 16. The belt 2 and straps 10 are made of reinforced fibre webbing.

In use, the belt 2 is arranged around a load to be lifted, the claw 6 and rod 4 are connected, and the ratchet tensioner 8 is operated back and forth to tighten the belt 2 around the load. At some stage prior to lifting, the straps 10 are positioned and spaced around the belt 2 as desired or necessary, preferably so as to provide the best weight load transfer to the lifting ring 16. More straps 10 can be added if desired or necessary around the belt 2, although a different lift attachment means may also be necessary. Once the load has been lifted and relocated, the tension in the belt 2 is released to allow disengagement of the claw 6 and rod 4. The whole lifting device is then immediately removable and ready for reuse.

Figure 2:
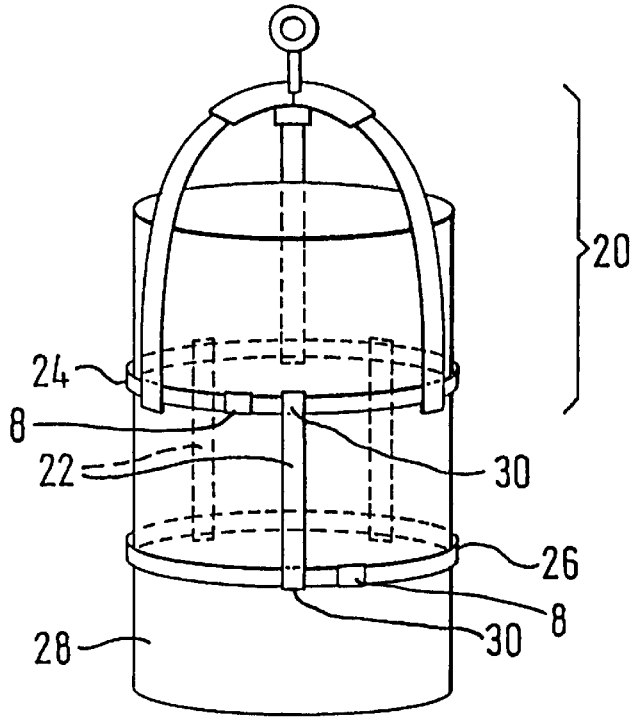
FIG. 2 is a perspective view of a lifting device according to a second embodiment of the present invention grasping a load.

In the second embodiment as shown in FIG. 2 in which like parts are denoted by like numerals, a lifting device has a top portion 20 similar to that shown in FIG. 1. A bottom portion is provided comprising a second series of lifting straps 22 depending from the first belt 2 to a second belt 26. The second lifting straps 22 are looped at each end 30 as to be easily added to or removed from the first belt 2.

The lifting device is shown grasping an upright elongate load 28. The second belt 26 provides increased stability of the load during lifting and moving. The belts 2, 26 are secured and released in a manner similar to that shown in FIG. 1.

Figure 4:
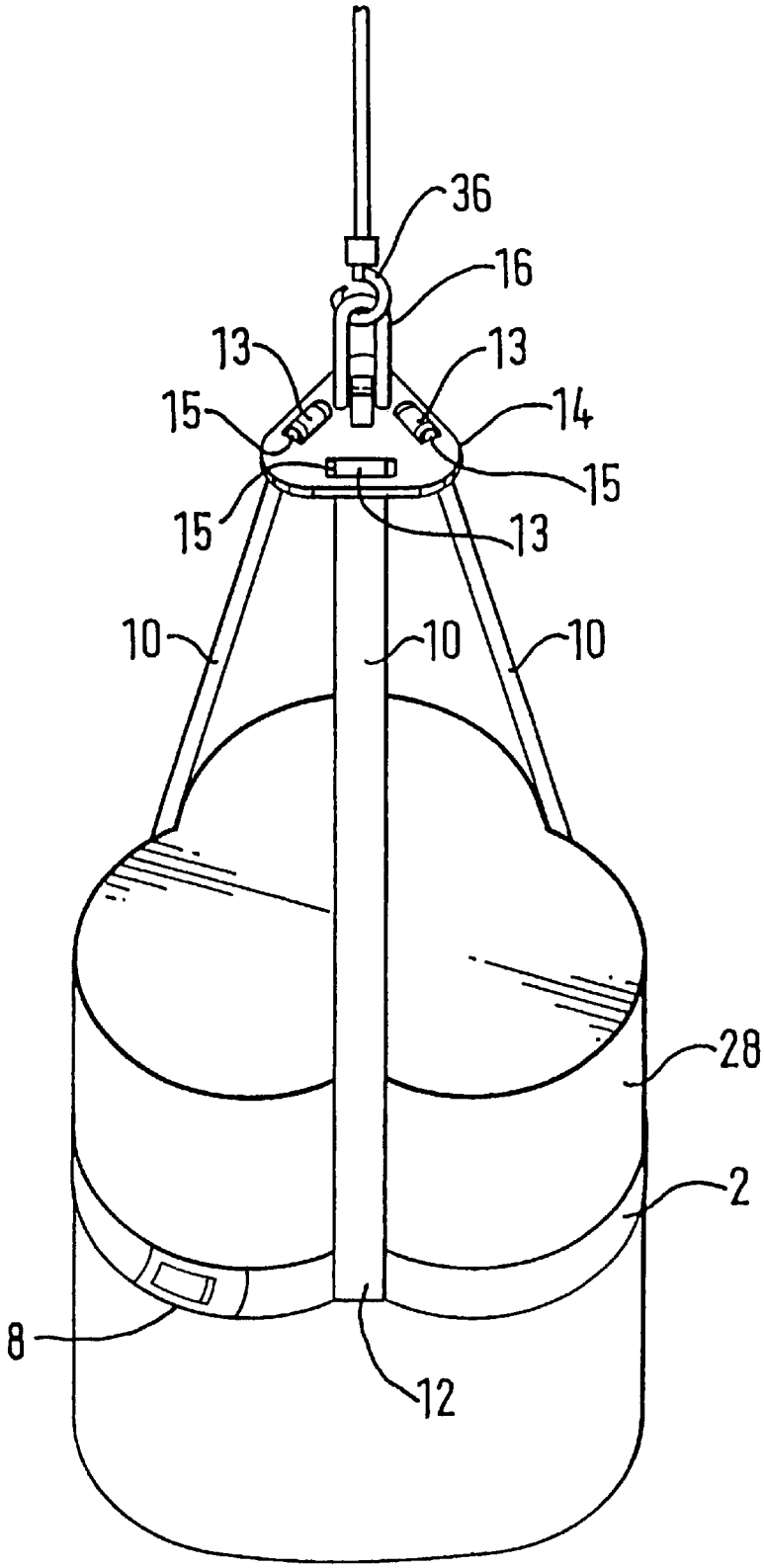
FIG. 4 is a perspective view of a lifting device and load and showing an enlarged common attachment head.
Figure 5:
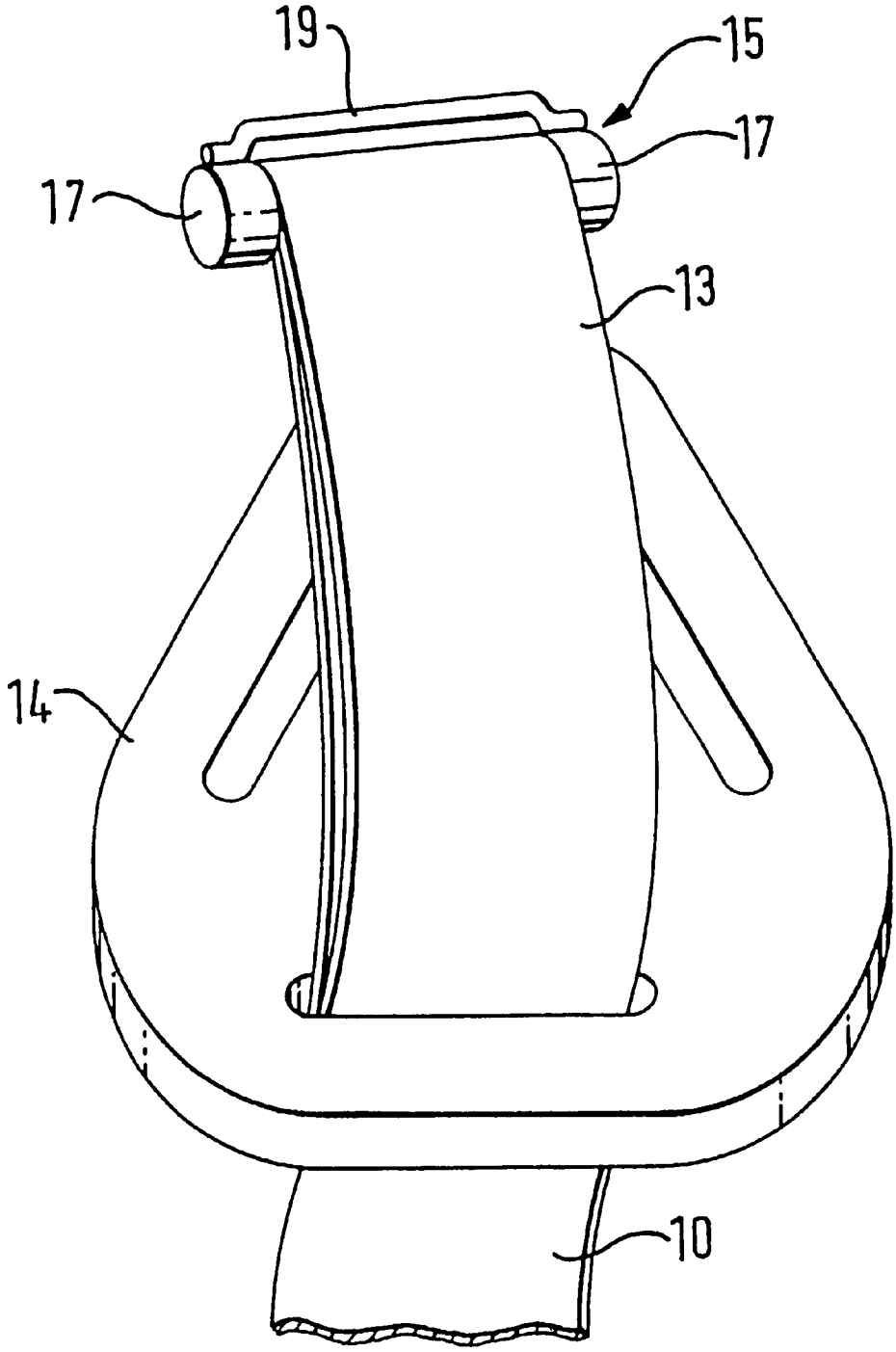
FIG. 5 is a side elevation of a part of the common attachment head showing a strap therethrough.

In a modification, the common attachment head 14 is a load plate of substantial triangular shape as shown in FIGS. 4 and 5 having inward of each side an elongated slot, the width and thickness of which allow passage of a strap 10. With this load plate, three straps 10 are used and the upper end of each strap 10 is provided with a loop 13. To secure a strap 10 to the plate, the looped upper end of each strap is passed through a respective slot. The closed loop for each strap is opened and a dumbbell pin 15 is threaded through for the webbing of each strap to seat between the enlarged ends 17 of a pin. Each pin 15 is of greater diametrical width than the width of a respective slot and cannot pass therethrough although the enlarged ends 17 will seat in the respective slot. Each of the loops at the end of straps 10 can have its inner side pulled through it's respective slot, so as to form a loose bulge, so that the effective length of each belt 10 can be shortened. When a load is lifted, the weight of the load retains the straps in their seated positions in the pins and the enlarged ends 17 in their seated position in the slot. A keeper 19 is welded across between the two enlarged heads 17 as shown.

As also shown in FIG. 4, a ratchet tensioner 8 is provided as a belt tightening means.

The lifting device is particularly suitable for the lifting and moving of the now common large round straw, hay and especially silage bales. The lifting device replaces the large and sometimes complex mechanical apparatus currently used to move such bales, which apparatus also requires time and effort to be attached and detached from the tractor linkage mechanism.

The lifting device is also non-intrusive into the load. This is especially in comparison with spiked lifting means which damage or mar load surfaces. Access underneath such bales is unnecessary for the lifting device of the present invention. The bales may thus be stacked very close to or on top of other bales (currently a near-impossible operation) to save space when loading e.g. onto trailers. The lifting device may also lower and locate a load, e.g. a whole round silage bale, in a controlled and desired manner into a container e.g. a fodder feeder. The rotating lifting ring 16 allows more precise positioning of the load.

Figure 3:
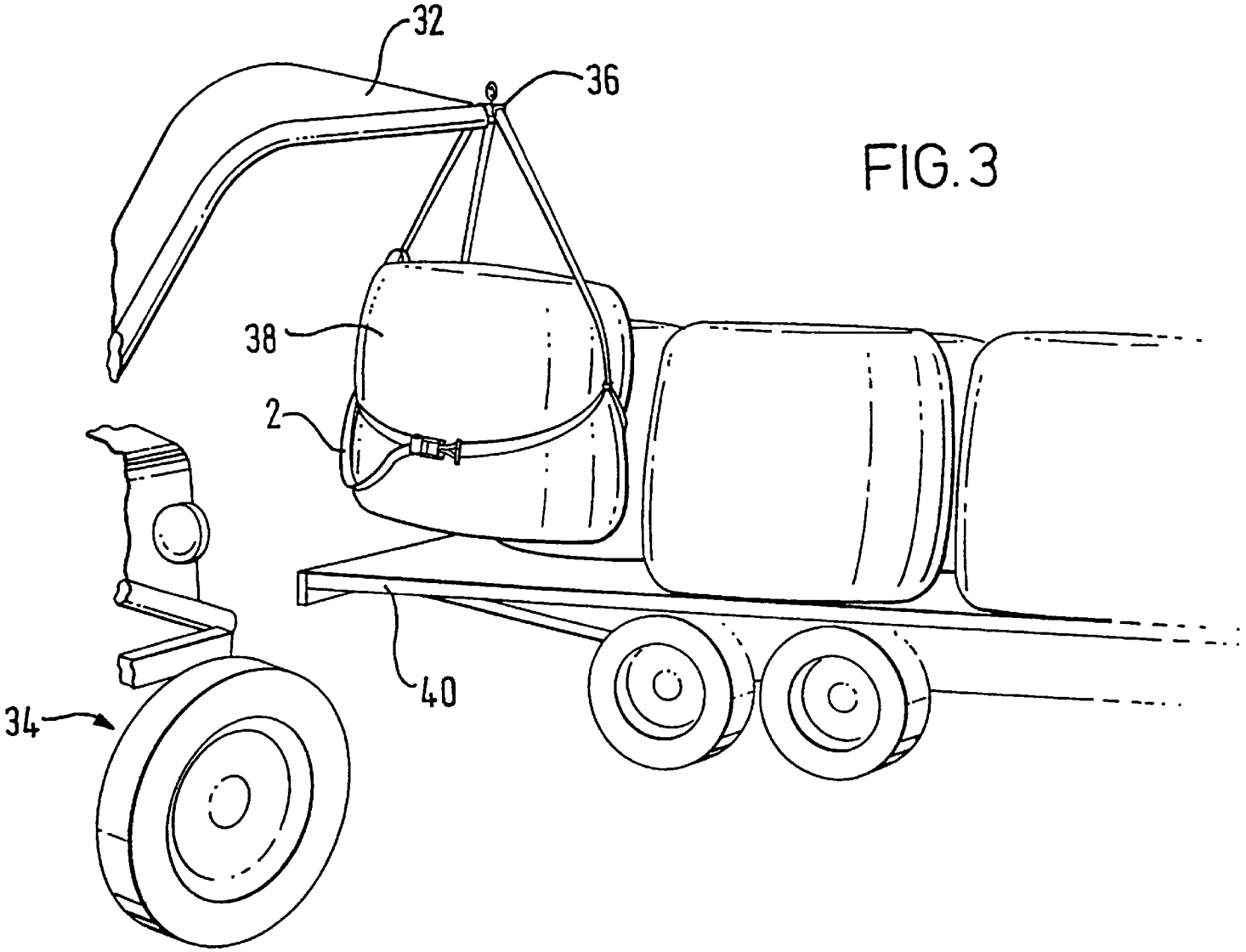
FIG. 3 is a perspective view of the device in FIG. 1 in use.

FIG. 3 shows the lifting device of FIG. 1 attached to a boom arm 32 on a tractor 34. A hook 36 on the end of the boom arm 32 supports the lifting ring 16. The belt 2 of the lifting device surrounds a silage bale 38 which is being lifted for stacking onto a trailer 40. The bales 38 can be stacked close together to save space. Further bales could be stacked above the first layer of bales 38.

Variations and modifications can be made without departing from the scope of the invention described above and as claimed hereinafter.

What is claimed is:

1. A lifting device comprising a first flexible belt for circumscribing and gripping a load to be lifted, and a plurality of first elongate flexible lifting straps in spaced relationships around the first belt, one end of each first lifting strap being securable on the first belt anywhere along the first belt's length, the other end of each first lifting strap having lift attachment means formed by a common attachment head to which the other ends of the lifting straps are brought together and secured, wherein the common attachment head is a multi-sided load plate having inward of each side an elongate slot for attaching the other ends of the lifting straps, wherein the upper end of each first lifting strap is provided with a loop for use in attachment to said attachment head and said first lifting straps are secured to the load plate by the looped upper end of each said first lifting strap being passed through a respective slot, and a dumbbell pin having enlarged ends is threaded through the loop in the upper end of each first lifting strap whereby the corresponding lifting strap seats between the enlarged ends of the pin.

2. A lifting device as claimed in claim 1, wherein the load plate is of substantial triangular shape.

3. A lifting device as claimed in claim 1, wherein said plurality of first lifting straps comprises at least three lifting straps.

4. A lifting device as claimed in claim 1, wherein the pin is greater in diametrical width than the width of a respective slot with the enlarged ends seating on the load plate.

5. A lifting device as claimed in claim 1, wherein the common attachment head is adapted to allow rotation of the device, and thus rotation of the load, in use.

6. A lifting device as claimed in claim 1, wherein said first belt is elongate and includes a two-part fastener belt fastening means.

7. A lifting device as claimed in claim 1, further comprising a belt tightening means operable to tighten the first belt around a load to be lifted.

8. A lifting device as claimed in claim 7, further comprising a two-part belt fastener operable to enable quick attachment and detachment of the lifting device to a load.

9. A lifting device as claimed in claim 1, wherein each said first lifting strap is detachable from the first belt either directly or slidingly for ready addition or removal as desired or necessary to increase or decrease the number of first lifting straps.

10. A lifting device as claimed in claim 9, wherein each said first lifting strap is length-adjustable.

11. A lifting device as claimed in claim 1, wherein the first belt is formed of a non-abrasive material to thereby provide non-abrasive gripping of the load.

12. A lifting device as claimed in claim 1, further comprising a second belt positioned below said first belt, and a second set of lifting straps extends between and is connected to said first and second belts, whereby said second belt is disposed below and depends from said first belt.

13. A lifting device as claimed in claim 12, wherein in use, said first belt and said second belt are of different circumferential lengths.

14. A lifting device as claimed in claim 1, wherein said first belt and said first lifting straps are made of lightweight, strong, and non-abrasive material which is vermin, water and chemical resistant.

* * * * *